US008726644B2

(12) United States Patent
Nellessen

(10) Patent No.: US 8,726,644 B2
(45) Date of Patent: May 20, 2014

(54) CONTROL OF UNDERWATER ACTUATORS USING AMBIENT PRESSURE

(76) Inventor: Peter Nellessen, Palm Beach Gardens, FL (US)

( * ) Notice: Subject to any disclaimer, the term of this patent is extended or adjusted under 35 U.S.C. 154(b) by 0 days.

(21) Appl. No.: 13/244,508

(22) Filed: Sep. 25, 2011

(65) Prior Publication Data

US 2013/0074687 A1 Mar. 28, 2013

(51) Int. Cl.
*F15B 3/00* (2006.01)

(52) U.S. Cl.
USPC ..... 60/398

(58) Field of Classification Search
USPC ..... 60/398
See application file for complete search history.

(56) References Cited

U.S. PATENT DOCUMENTS 4,649,704 A * 3/1987 Marsh ..... 60/413
4,777,800 A * 10/1988 Hay ..... 60/593
2008/0185046 A1* 8/2008 Springett et al. ..... 60/413

* cited by examiner

*Primary Examiner* — F. Daniel Lopez
(74) *Attorney, Agent, or Firm* — Kevin Mark Jones

(57) ABSTRACT

A device for controlling an underwater actuator by using an ambient pressure potential at the operating depth may include a chamber including a first cavity, a second cavity and a third cavity; the first cavity including a gas at a first pressure including one of at surface atmospheric pressure, lower than surface atmospheric pressure, or a vacuum; the second cavity including a first fluid at a second pressure including at least one of at underwater ambient pressure or higher then underwater ambient pressure and being connected to a underwater fluid supply; the third cavity including a second fluid at a third pressure including at least one of underwater ambient pressure or higher than the underwater ambient pressure and being connected to the actuator.

18 Claims, 4 Drawing Sheets

CONTROL OF UNDERWATER ACTUATORS USING AMBIENT PRESSURE

FIELD OF THE INVENTION

The present invention relates to actuators and more particularly to underwater actuators.

BACKGROUND

Underwater actuators may be required to be operated quickly. Actuators that use control fluids require a pressure source that is higher than the ambient pressure at the operating depth in order to operate. The pressure sources include pumps and gas charged accumulators. High flow pumps are required to operate high flow demand fluid actuators. However, accumulators may lose efficiency due to adiabatic discharge under high flow demands. As water depth increases, these devices become less efficient, which is undesirable.

Existing designs have focused on increasing the efficiency of the positive pressure portion of the system that acts on the actuator piston and have ignored the potential to use the pressure generated at a depth as a source to operate the actuator. This focus has resulted in using either a combination of larger pumps, accumulators with higher gas pre-charge pressures, changing the pre-charge gas to helium instead of nitrogen, adding accumulators or increasing accumulator working volume capacity by using depth compensated accumulators in deep water. In deep water operations, these solutions decrease efficiency and reliability, add weight (by adding larger pumps or more accumulators), increase logistics issues (using helium instead of nitrogen as the pre-charged gas), or add complexity and potential for seal leakage due to cycling (depth compensated accumulators).

SUMMARY

Described herein is a device for controlling an underwater actuator and a method of utilizing same. The device (described herein as a sub-actuator) having a chamber including at least three cavities, a piston dividing at least two of the cavities, and a fixed divider creating the third cavity. The piston is connected to a rod with the distal end extending into the remaining cavity through the fixed divider. The remaining cavity optionally including a second piston joined to the distal end of the rod dividing the remaining cavity into two cavities, thus resulting in a total of four cavities, the volumes of each related in size by the position of the rod and pistons. All cavities being sealed within the chamber against pressure, fluid, and/or gas leakage there between. The cavities varying in volume and pressure in compensation of external forces placed there between.

The system further comprising a plurality of valves to selectively connect the cavities of the sub-actuator to either chamber of the actuator, thus manipulating the position of the actuator's piston. The system optionally including accumulators, fluid supplies, reservoirs, purge valves, filters, vents, and other equipment, the specifics of which are not within the scope of this innovation.

The system further comprising three proximate pressures applied to differing cavities, thus moving the pistons and rods there between. The first pressure (high pressure) being applied by a fluid at substantially higher than underwater ambient pressure. The second pressure (medium pressure) being applied by a second fluid at or near underwater ambient pressure. The third pressure (low pressure) being applied by a gas at near surface atmospheric pressure, lower than surface atmospheric pressure, or a vacuum.

Operation of the actuator is accomplished by selectively applying pressure differential either directly to the actuator, or indirectly to the actuator via the sub-actuator. The first pressure differential may be between the high pressure and the medium pressure, a second pressure differential existing between the medium pressure and the low pressure, and a third differential existing between the high pressure and the low pressure. Each selectively applied for operation depending on the state of the system, the desired action, and speed and/or force of the actuator.

In the preferred embodiment, the high pressure is maintained by an accumulator, an umbilical fluid supply, or a subsea hydraulic power unit. One skilled in the art would appreciate that maintaining high pressure hydraulic fluids at depth is regularly accomplished in the industry and the particular method of doing so is not claimed within the scope of this innovation.

In the preferred embodiment, the medium pressure is maintained by a reservoir tank, an umbilical fluid line, an external vent to the environment at or near depth. One skilled in the art would appreciate that maintaining a medium pressure which is at or near ambient pressure at depth is regularly accomplished in the industry and the particular method of doing so is not claimed within the scope of this innovation.

In the preferred embodiment, the low pressure is maintained by a cavity, which is equalized with ambient pressure at the surface and sealed prior to submersion. A gas purge value is maintained in the cavity which allows the pressure to be further established by reducing the cavity volume to near zero and venting any pressure generated by reducing the cavity volume into the environment. One skilled in the art would appreciate that this could be accomplished at any depth as a volume of near zero would be insignificantly affected. Further external sources such as pumps, umbilical, remote vehicles, etc., may be attached to the appropriate cavity valve while manipulating the piston position to produce the correct pressure in the cavity with desired gas or fluid.

In this description, the actuator and the sub-actuator are shown as two distinct units for clarity and ease of explanation. One skilled in the art would appreciate that the sub-actuator and the actuator are not required to be individual/separate units. They may share housing, and one or more cavities may be combined into a single cavity, depending on the specific operational requirements of the system.

DETAILED DESCRIPTION OF THE INNOVATION

The preferred embodiment, takes advantage of the fluid column which may be a fresh water or salt/sea water column or other appropriate fluid, and which creates a higher underwater ambient pressure (a medium pressure) at a predetermined depth than at the surface of the fluid or at least a partial vacuum (a low pressure), and couples these with the normal high pressure sources to produce multiple pressure differences to operate the actuator directly or indirectly. The actuator or sub-actuator uses the difference between medium pressure and low pressure to operate an actuator or it may use the difference between high pressure and medium pressure to operate the actuator.

Additionally, it may utilize the difference between high pressure and low pressure to operate the actuator producing higher speed and/or more force for select operations. When one chamber cavity is connected to one side of an actuator piston and a different chamber cavity is connected to the other side of an actuator piston, it can create a pressure differential on the piston causing the piston to move toward the side with the lower pressure. The pressure differential created on the actuator piston can be used to either operate an underwater device or operate it with less pressure above underwater ambient than would previously be required using a pressure source such as accumulators and/or pumps alone.

As discussed above, normal underwater actuators lose efficiency as water depth increases due to the decrease in pressure differential between the high pressure and the ambient pressure. By utilization of a low pressure chamber, which is significantly lower than the ambient pressure, greater water depth does not have significant effect on efficiency; thus when higher speeds or higher forces are desired, the pressure differential between the high pressure and the low pressure allows efficient piston and actuator operation.

Figure 1:
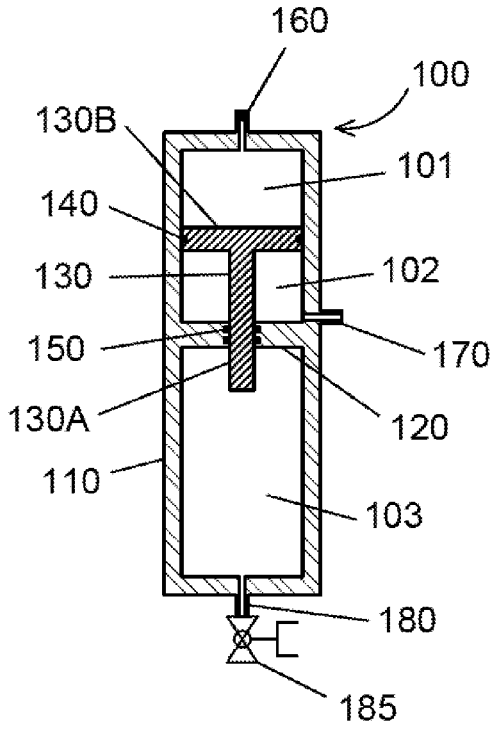
FIG. 1 illustrates a cross-sectional view of a three cavity sub-actuator in accordance with an exemplary embodiment of the innovation.

FIG. 1 illustrates a cross-sectional view of a three cavity sub-actuator in accordance with an exemplary embodiment of the innovation. The sub-actuator (100) has a housing (110) with two chambers (not designated) separated by a bulkhead (120) through which passes a rod (130A) having a piston (130B) attached to one end. The piston (130B) divides one chamber into a first cavity (101) and a second cavity (102). The second chamber forms a third cavity (103).

A first port (160) opens to the first cavity (101). A second port (170) opens to the second cavity (102). A third port (180) opens to the third cavity and is secured with a valve (185) which is optionally operable by a Remotely Operated Vehicle (ROV) (10, not illustrated). A piston seal (140) around the piston (130B) secures the first cavity (101) and the second cavity (102) against leakage there between. A rod seal (150) secures the second cavity (102) and the third cavity (103) against leakage there between.

Figure 2:
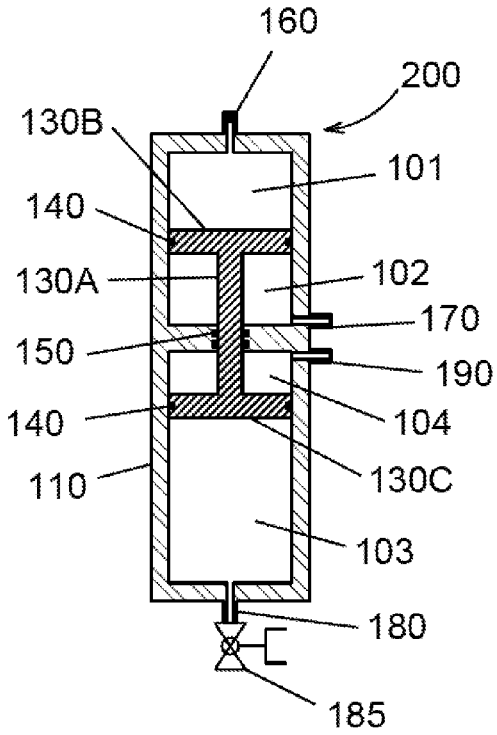
FIG. 2 illustrates a cross-sectional view of a four cavity sub-actuator in accordance with an exemplary embodiment of the innovation.

FIG. 2 illustrates a cross-sectional view of a four cavity sub-actuator in accordance with an exemplary embodiment of the innovation. This sub-actuator (200) has a second piston (130C) attached to the distal end of the rod (130A) which divides the second chamber into a third cavity (103) and a fourth cavity (104). The piston has a piston seal (140) to secure the third and fourth cavities (103 & 104) against leakage there between. A rod seal (150) secures the second cavity (102) and the third cavity (103) against leakage there between. Port (190) opens to the fourth cavity. All other parts are as referenced in FIG. 1 above.

Figure 3:
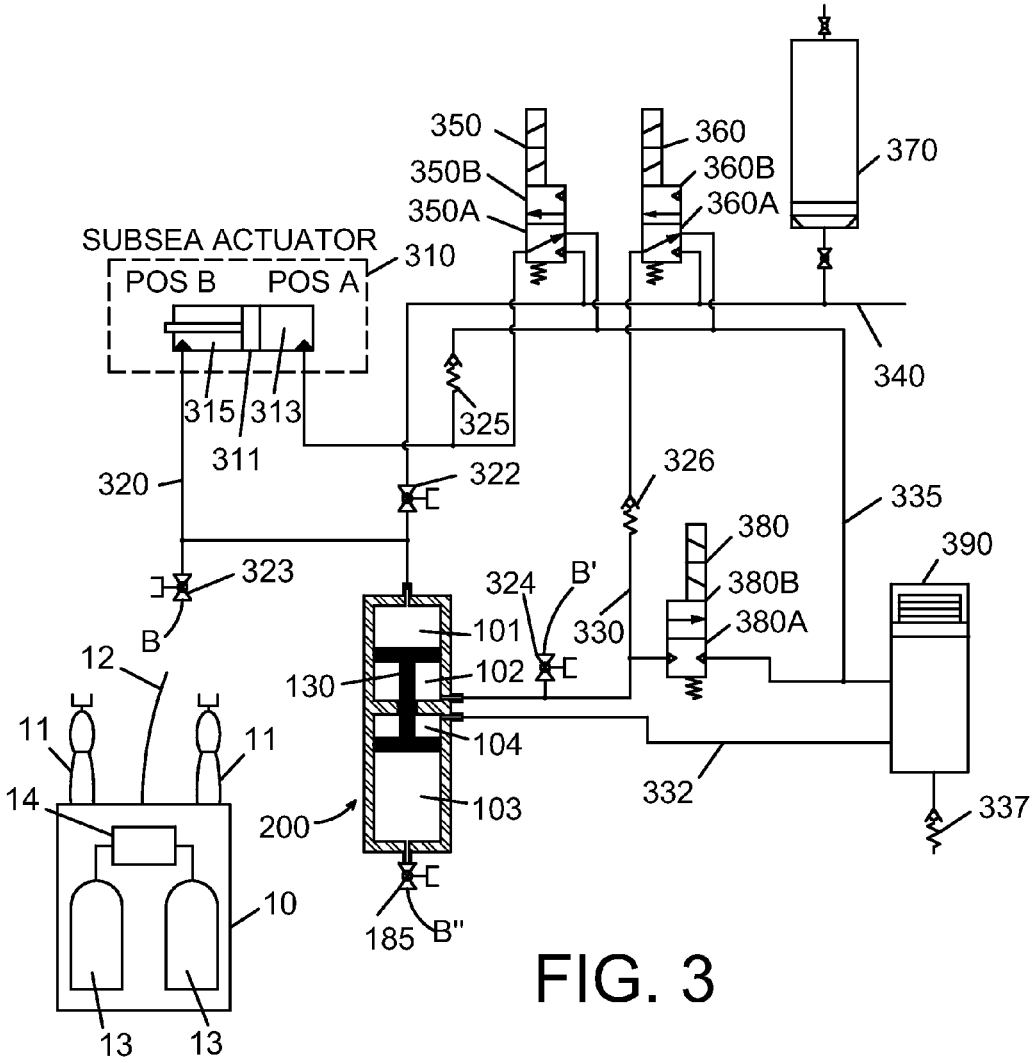
FIG. 3 illustrates a circuit diagram for use of a sub-actuator to control a subsea actuator utilizing umbilical fluid supplies in accordance with an exemplary embodiment of the innovation.

FIG. 3 illustrates a circuit diagram for use of a sub-actuator to control a subsea actuator utilizing umbilical fluid supplies in accordance with an exemplary embodiment of the innovation. The subsea actuator (310) comprises a piston (311) which is moved between a first position (POS A) and a second position (POS B). Movement to the second position (POS B) is accomplished by pumping fluid in a first chamber (313) and removing it from a second chamber (315). Movement to the first position (POS A) is accomplished by pumping fluid in a second chamber (315) and removing it from a first chamber (313).

During normal operation, a plurality of solenoid valves (350, 360, 380) and pressure relief or check valves (325, 326, and 337) are used to route fluids through various lines (320, 332, 335, 330) from high pressure sources (340 & 370) and medium pressure sources (390) to create pressure differentials in cavities (315, 313, 101-104) which act against one another to position pistons (311 & 130) in the actuator (310) and the sub-actuator (200). A plurality of valves (322, 323, 324, and 185) may be remotely accessed and/or controlled by ROV's (10) controllable articulated arm (11) or other external manipulators to adjust or override the system's normal operation. Valves (323, 324, and 185) may also removably connect to an ROV (10) via the valve's open connection (B, B', and B") which is coupled to the ROV's (10) connection line (12). Once connected to the system, the ROV (10) may manipulate the valves (323, 330, 185) with articulated arms (11) to allow the ROV's (10) pump and manifold system (14) to add or remove fluids and/or gases between the system and onboard tanks (13).

Figure 4:
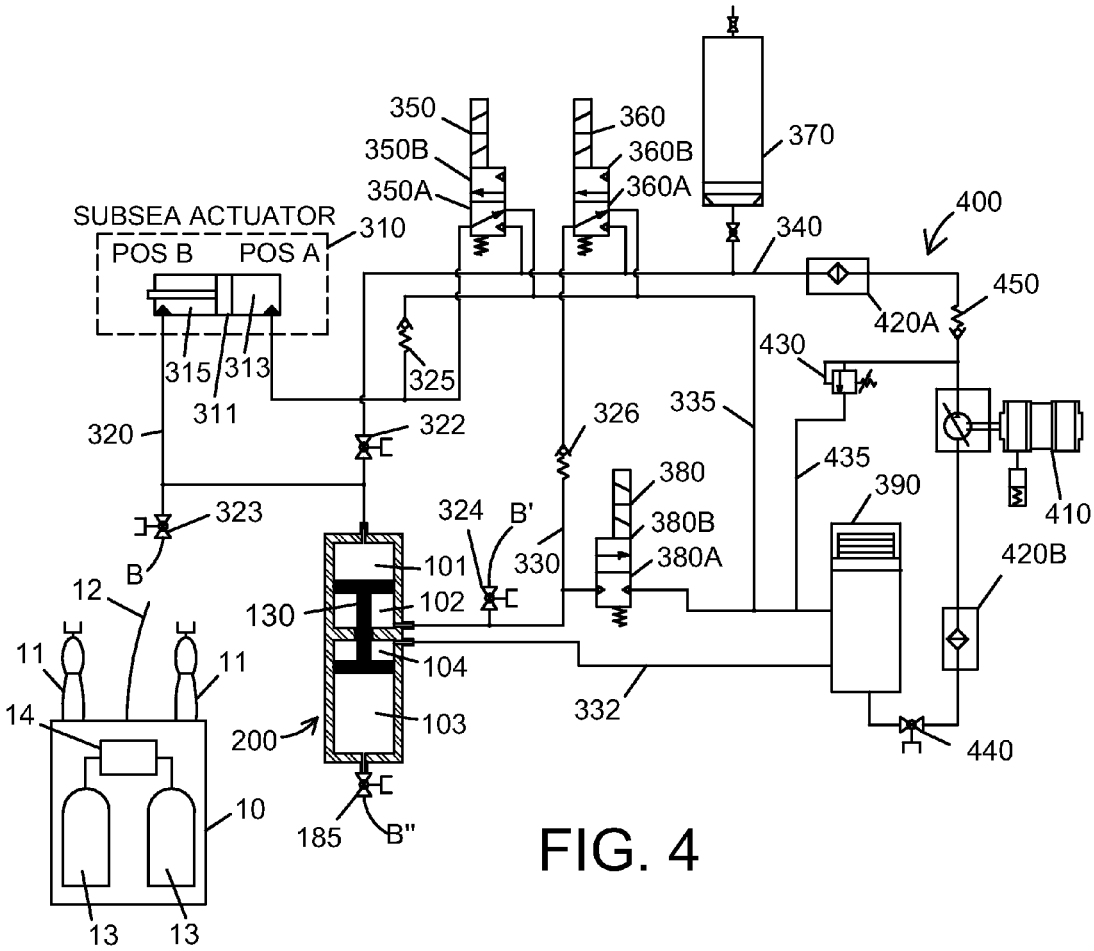
FIG. 4 illustrates a circuit diagram for use of a sub-actuator to control a subsea actuator utilizing a subsea hydraulic power unit in accordance with an exemplary embodiment of the innovation.

FIG. 4 illustrates a circuit diagram for use of a sub-actuator to control a subsea actuator utilizing a subsea hydraulic power unit in accordance with an exemplary embodiment of the innovation. A system (400) may eliminate the need for an umbilical fluid supply by locating a subsea hydraulic power unit (HPU) (410) near the actuator (310). Fluid from the reservoir (390) is pumped by the HPU (410) to the fluid supply line (340). A check valve (450) prevents the pressure from flowing backwards through the system. Filters (420A & 420B) ensure a clean fluid supply, and relief valves (430) and a diverter line (435) prevent over pressure by bleeding fluid directly to the reservoir (390), thus bypassing the actuators and associated equipment. All other parts are as referenced in FIG. 3 above.

The innovation described herein allows a plurality of pressure differentials to accommodate several desired operations. Further, the innovation described provides the ability to operate the actuator utilizing secondary pressure differentials available in the system when failures occur.

In normal operation, the subsea actuator is manipulated by establishing a pressure differential on both sides of the piston and allowing/causing the piston to relocate to adjust volume of the cylinder while attempting to equalize the pressure. It is common practice in subsea actuators that the pressure differential is a high pressure which is significantly above ambient pressure at depth, and an ambient pressure at depth. Both of these pressures are established in relation to the depth and may vary depending on the environment in which the innovation is utilized.

In reference to FIG. 3, the following description illustrates an exemplary operation which utilizes a high pressure supply (340) to move the subsea actuator (310) in the direction of Position A (POS A). To initiate the movement of the subsea actuator (310) in the direction of POS A the valve (360) is opened (360B) to connect the high pressure source (340) to the second cavity (102). This moves the piston (130), decreasing the volume of the first cavity (101) and displacing the fluid through the line (320) to the second cavity (315). Fluid from the first cavity (313) displaced by the actuator's movement flows through the value (350) to the medium pressure line (335) to the reservoir (390).

Another exemplary operation is to move the subsea actuator (310) in the direction of Position B (POS B) by opening (380B) the valve (380) connecting the second cavity (102) to the reservoir (390). The low pressure in the third cavity (103)

biases the piston (130) to move such as to reduce the volume of the low pressure cavity (103) to relieve the pressure differential of all cavities.

Since the fourth cavity (104) is connected to the reservoir (390) and the second cavity (102) is connected to the reservoir, there is no resistance to movement of the piston (130) in these cavities as fluid flows freely between them during movement. Movement of the piston (130) to reduce the volume in the low pressure cavity (103) causes it to draw in fluid from the actuator's chamber (315). This moves the piston toward POS B, drawing fluid into the chamber (313) on the distal end of the actuator. The fluid into the distal chamber (313) is supplied by the valve (350) in its default position (350A) from the reservoir (390). In short, by opening (380B) the valve (380), the first (101), second (102), and fourth (104) cavities are connected to the medium pressure of the reservoir (390), and the actuator (310) is moved to POS B by the force of the vacuum in the third cavity (103).

Another exemplary operation is to move the subsea actuator (310) in the direction of Position B (POS B) by opening (350B) the valve (350) connecting a chamber (313) of the actuator (310) to the high pressure supply (340), and opening (380B) the valve (380) connecting the second cavity (102) to the reservoir (390). The high pressure line (340) fills the chamber (313) moving the piston (311) of the actuator toward POS B. This reduces the volume of the second chamber (315) which displaces fluid into the first cavity (101) causing a high pressure therein. This high pressure in the first cavity (101) offsets the vacuum in the third cavity (103) moving the piston (130) of the sub-actuator (200) downward. Since the second (102) and fourth (104) cavities are connected to the reservoir, (390) they offer no resistance to the movement.

The high pressure in the first chamber (313) transmits this pressure to the first cavity (101). The high pressure in the first cavity (101) is offset by the medium pressure in the second cavity (102) but is supplemented by the medium pressure in the fourth cavity (104). The resulting high pressure acts against the vacuum in the third cavity (103). This results in a pressure differential between the high pressure in the first cavity (101) and the vacuum in the fourth cavity, (104) which is higher than the pressure differential in normal operation. This offers a new option of faster operation with more force of operation in desired situations. One skilled in the arts would appreciate that the pressure thus available may be used, or may be tempered in various ways when such is not necessary.

The figures also illustrate strategic placement of additional valves (322, 323, 324, and 185) which are illustrated as Remote Operated Vehicle (ROV) valves utilizing industry standard symbols. In desired situations, an ROV can connect to a valve (323) to move the actuator (310) directly without concern for the operations of the sub-actuator (200). This is accomplished by coupling the ROV's (10) connection line (12) to the valve's open connection (B). Once connected to the system, the ROV (10) may manipulate the valve (323) with articulated arms (11) to allow the ROV's (10) pump and manifold system (14) to add or remove fluids and/or gases between the system, and onboard tanks (13). Such operation may be desirable in situations where the high pressure supply line (340) umbilical, as in FIG. 3, is not connected, or when a malfunction in the HPU (410), as in FIG. 4, prevents normal operations. Another desired situation is when the solenoid valves (350, 360, and 380) malfunction.

To move the actuator (310) toward POS A, the ROV (not shown) would induce a high pressure into the first chamber (315). The fluid forced from the distal chamber (313) by this operation travels through the solenoid valve (350) in its default position (350A) to continue to the reservoir (390) through the medium pressure line (335). One skilled in the arts would appreciate that the primary purpose of an ROV is to accomplish the work of divers in environments where divers are not available or not desirable. Activities described above as accomplished by an ROV may also be accomplished by appropriately equipped divers in proper environments.

To move the actuator (310) toward POS B, the ROV (not shown) would induce a low pressure into the first chamber (315). The fluid sourced into the distal chamber (313) by this operation travels through the solenoid valve (350) in its default position (350A), or through the pressure relief valve (325) from the reservoir (390) through the medium pressure line (335).

Further, an ROV (10) connected to the valve (323), by also opening the valve (322) connecting to the high pressure line, (340) may be utilized to recharge the accumulator (370). Additionally, this recharge may take place by connecting the ROV (10) to the valve's (324) open side (B') which draws fluid from the reservoir (390) either through one of two solenoids (360 or 380).

An ROV (10) may override operations of the system when connected, such as to valve (323), by closing the valve (322) connecting to the high pressure line, (340) then utilizing onboard pumps (14) and tanks (13) to push fluid through the connection line (12) and the open port (B) on valve (322) into the system. This operation directly allows the Actuator (310) to be moved from Pos B to Pos A by adding high pressure fluid to the cavity (315) through the line (320). The resulting fluid from cavity (315), generated by the repositioning of the piston (311) would flow to the reservoir (390) through valve (350A).

The chamber can be produced by machining the parts and assembling them. The parts may be made from metals or plastics compatible with the environment. Standard elastomeric seals on the piston(s) may be used to seal the cavities from each other. The same manufacturing and assembly techniques used to manufacture hydraulic cylinders may be used to produce the chamber and the cavities within it. The balance of the parts required can be procured using readily available parts and assembled by persons skilled in the arts.

The circuit described shows one way the chamber can be installed in the underwater system. A single chamber can be used to operate many actuators or can operate only one. Multiple chambers can also be used in various combinations.

The methods and apparatus described may be relevant to all underwater operations and may be useful specifically in deep water in underwater military, scientific and commercial oil and gas operations. Typical examples in the offshore oil and gas industries may include, operation of equipment for drilling, coring, production, and all intervention operations.

The system may be used in any underwater environment where a pressure differential can be generated or any environment where there may be a pressure differential generated by ambient conditions, such as inside a pressure vessel or in a submarine.

While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed.

The invention claimed is:

1. A device for controlling an underwater actuator, comprising:

a pressure chamber including a first cavity, a second cavity and a third cavity the first cavity being separated from the second and third cavities by a bulkhead;

a rod projecting through the bulkhead and connected at one end to a first piston, said first piston dividing the second and third cavities;

the first cavity including a gas at a first pressure being one of at or near surface pressure, or at a vacuum;

the second cavity including a fluid which is switched between underwater ambient pressure or higher than the underwater ambient pressure;

the third cavity changing pressure based on the pressure in the second cavity, and being connected to the underwater actuator, so that switching pressure in the second chamber causes the underwater actuator to change position.

2. A device for controlling an underwater actuator as in claim 1, wherein the pressure chamber includes a fourth cavity positioned between the first cavity and the second cavity;

wherein said forth cavity includes fluid at or near underwater ambient pressure; and the forth cavity is separated from the first cavity by a second piston connected to the end of the rod projecting through the bulkhead.

3. A device for controlling an underwater actuator as in claim 1, wherein said second cavity further comprises a port connected to a valve which may block flow to or from the cavity preventing said actuator and said first piston from moving.

4. A device for controlling an underwater actuator as in claim 1, further comprising:

a hydraulic supply which supplies fluid at higher than ambient pressure the pressure is utilized in the operations, resulting in lower pressure fluid;

the lower pressure fluid then is exhausted to the environment.

5. A device for controlling an underwater actuator as in claim 1;

wherein said gas at a first pressure in the first cavity can control the actuator piston position by allowing fluid to free flow to or from the second cavity.

6. A device for controlling an underwater actuator as described in claim 1, further comprising:

a plurality of valves connected to the second cavity for controllably diverting fluid to and from the second cavity thereby positioning the actuator.

7. A device for controlling an underwater actuator as described in claim 4 wherein the hydraulic supply further comprises an accumulator which stores and supplies fluid at a pressure higher than the underwater ambient pressure.

8. A device for controlling an underwater actuator as described in claim 7, further comprising:

a hydraulic reservoir for receiving fluid at underwater ambient pressure and storing said fluid for reuse.

9. A device for controlling an underwater actuator as described in claim 8, wherein fluid from the reservoir is pumped to the accumulator.

10. A device for controlling an underwater actuator as described in claim 6, wherein the valves are solenoid valves operated by remote command from a controller.

11. A device for controlling an underwater actuator as described in claim 6, wherein the valves are solenoid valves operated by automatic response from a monitoring unit.

12. A device for controlling an underwater actuator as described in claim 6 wherein the valves are manually operable by a diver.

13. A device for controlling an underwater actuator as described in claim 6 wherein the valves are operable by a remotely operated vehicle.

14. A device for controlling an underwater actuator as described in claim 13 and further including one or more ports selectively engagable by the remotely operated vehicle, to adjust fluid pressures and/or quantities in at least one of the cavities.

15. A device for controlling an underwater actuator, comprising:

at least three separate cavities, the cavities being mechanically coupled such that changes in pressure and/or volume in one cavity affects the pressure and/or volume of the other cavities;

the first cavity having an initial volume substantial less than that of the other cavities, or with an initial pressure substantially lower than ambient pressure;

the second cavity including a fluid which is switched between underwater ambient pressure or higher than the underwater ambient pressure;

the third cavities being fluidly connected to at least one side of an actuator so that switching pressure in the second cavity causes the actuator to change position.

16. A device for controlling an underwater actuator as described in claim 15 wherein the volume of the first cavity is filled with a gas.

17. A device for controlling an underwater actuator as described in claim 15, wherein the device comprises a hydraulic supply by which fluid at higher than ambient pressure is supplied and the pressure is utilized in the operations, resulting in lower pressure fluid;

the lower pressure fluid being exhausted into a reservoir;

the hydraulic supply drawing fluid from the reservoir, and increasing the fluid pressure to supply fluid at higher than ambient pressure.

18. A device for controlling an underwater actuator as described in claim 15, wherein the device comprises a hydraulic supply by which fluid at higher than ambient pressure is supplied and the pressure is utilized in the operations, resulting in lower pressure fluid;

the lower pressure fluid being exhausted into the environment.

* * * * *